US005140565A

United States Patent [19]

Katsma

[11] Patent Number: 5,140,565

[45] Date of Patent: Aug. 18, 1992

[54] CYCLOIDAL PENDULUM

[76] Inventor: Robert W. Katsma, 615 Scenic View Dr., College Place, Wash. 99324

[21] Appl. No.: 855,832

[22] Filed: Mar. 23, 1992

[51] Int. Cl.[5] ..... G04B 15/00; G04B 17/02

[52] U.S. Cl. ..... 368/134; 368/179

[58] Field of Search ..... 368/134–138, 368/165–166, 179–183

[56] References Cited

U.S. PATENT DOCUMENTS 440,441 11/1890 Schwartz ..... 368/134

1,933,087 10/1933 Battegay ..... 368/165

*Primary Examiner*—Vit W. Miska

[57] ABSTRACT

An isochronous pendulum for clocks. The oscillation of the pendulum causes a small compensating mass attached to the pendulum's primary mass to move in such a manner that the center of mass of the pendulum moves in the path of a cycloid.

6 Claims, 4 Drawing Sheets

CYCLOIDAL PENDULUM

FIELD OF THE INVENTION

This invention relates to clocks, specifically to such clocks that use a pendulum to regulate the rate of movement.

DESCRIPTION OF THE PRIOR ART

An important physical characteristic of pendulums necessary for good timekeeping is a period of vibration that is independent of amplitude. When a pendulum exhibits a constant period for all amplitudes it is said to be isochronous.

In 1659 the Dutch physicist Christian Huyghens discovered that ordinary pendulums, ones in which the weight follows the path of a circle, do not produce vibrations which are isochronous. He further proved that to be isochronous the weight of the pendulum must follow the path of a cycloid. See FIG. 4. A cycloid is the curve traced by a point on the circumference of a circle that rolls on a straight line. The error in timekeeping resulting from the weight following a circular path instead of the required cycloidal path is known as circular error.

To make the weight of the pendulum follow a cycloid, Huyghens suspended his pendulum by silk threads which swung against specially curved brass cheeks. This arrangement improved the clocks of the era which had pendulum amplitudes from 60 to 80 degrees. But with the introduction of newer escapements that required less than 10 degrees amplitude, it was found that the cheeks did more harm than good, and they were abandoned. The reason that the cheeks do more harm than good for small amplitudes is that the difference between a circle and a cycloid is so small that it is impossible to make the correction accurately. But as the amplitude increases to values used by Huyghens, the difference between a circle and a cycloid becomes greater so that the correction can be made with sufficient accuracy to increase timekeeping accuracy. See FIG. 4.

Cheeks were later improved and used in the early 1700s by John Harrison of London with some success on pendulums with amplitudes from 8 to 12 degrees. But modern pendulum amplitudes are less than 4 degrees, and again the cheeks do more harm than good.

Efforts to make modern small amplitude pendulums isochronous have focused on the additions of springs, the most successful being made by a Russian engineer, Feodosii Mikhailovich Fedchenko, in the early 1950s. The problem with Fedchenko's solution is not one of performance but of aesthetics. With the advent of electronics there are relatively few mechanical clocks being made and even fewer high-quality mechanical clocks. And the few high-quality mechanical clocks are primarily bought by collectors and enthusiasts. For these collectors, the clocks they buy must not only perform well, but they must also be beautiful and intriguing to watch. Furthermore, enthusiasts have a mistrust of the ability of springs to work properly over many years of operation.

OBJECTS AND ADVANTAGES OF THE INVENTION

Accordingly, several objects and advantages of the present invention are as follows:

(a) to provide an isochronous small amplitude pendulum;

(b) to provide an isochronous pendulum that does not rely upon springs to supply the necessary forces to obtain isochronism;

(c) to provide an isochronous pendulum that is stable over many years of operation;

(d) to provide an isochronous pendulum that is attractive and fascinating to watch.

Still further objects and advantages will become apparent from a consideration of the ensuing description and drawings.

REFERENCE NUMERALS IN DRAWINGS

Figure 1:
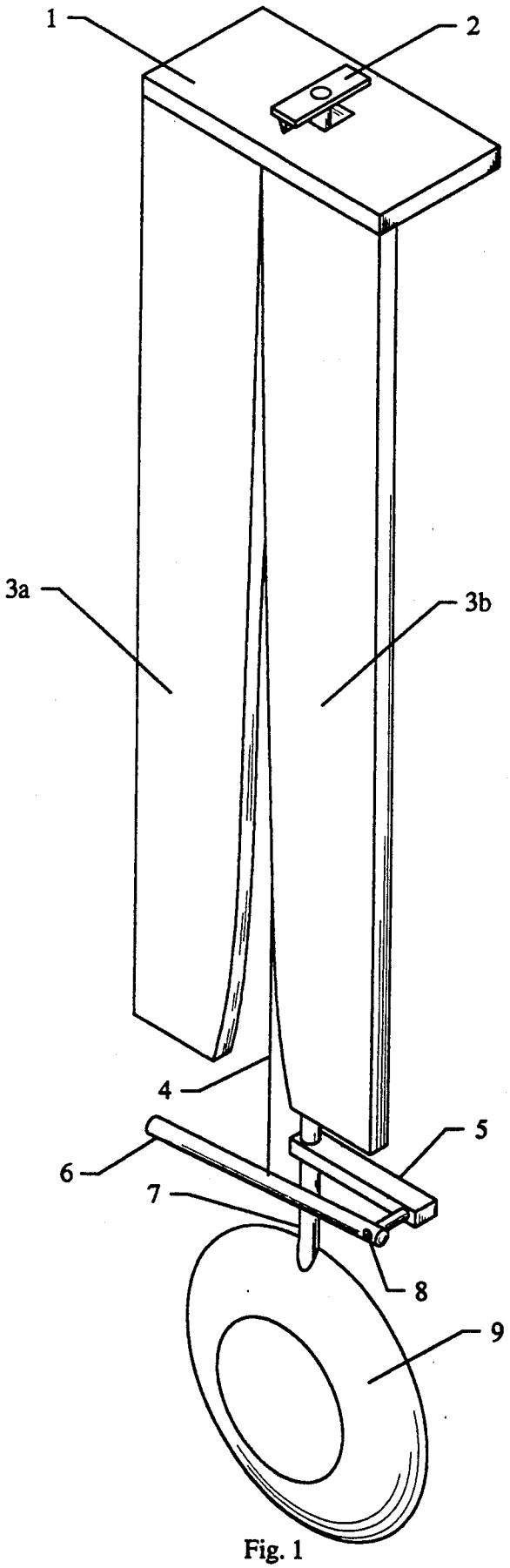
FIG. 1 is an isometric view of this invention with the pendulum at zero degrees amplitude.

1 foundation
2 knife-edge pivot
**3*a*** left cheek
**3*b*** right cheek
4 suspension line
5 pivot mount
6 compensating mass
7 pendulum rod
8 compensating mass pivot
9 pendulum weight

DESCRIPTION OF THE INVENTION

Figure 2:
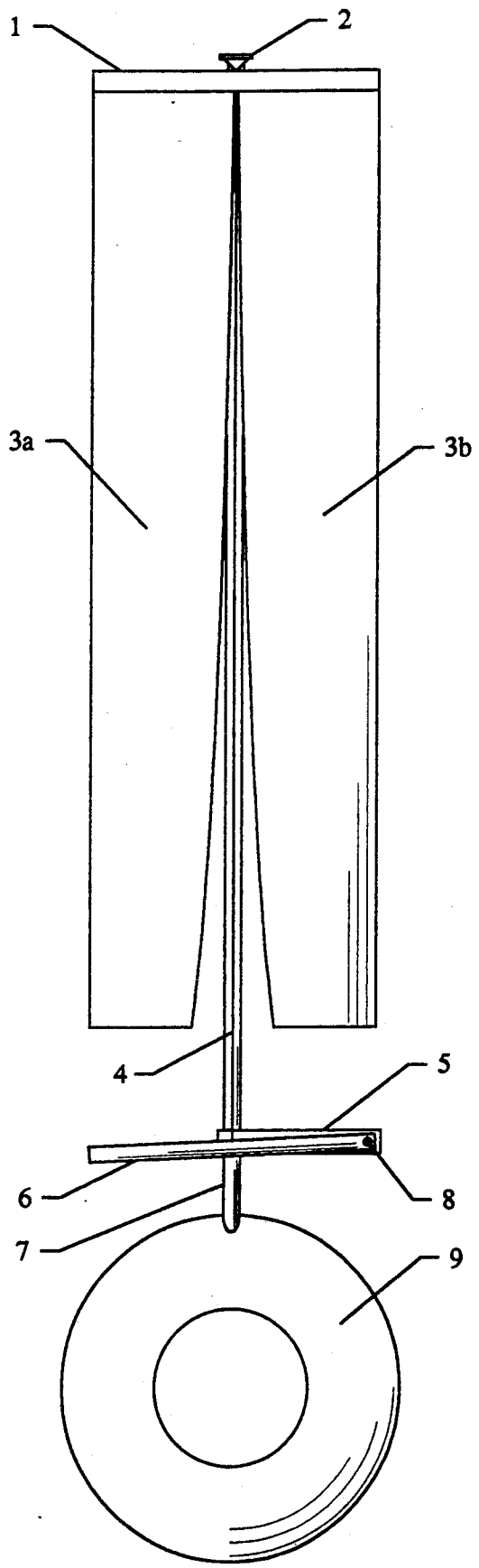
FIG. 2 is a front view of this invention with the pendulum at zero degrees amplitude.
Figure 3:
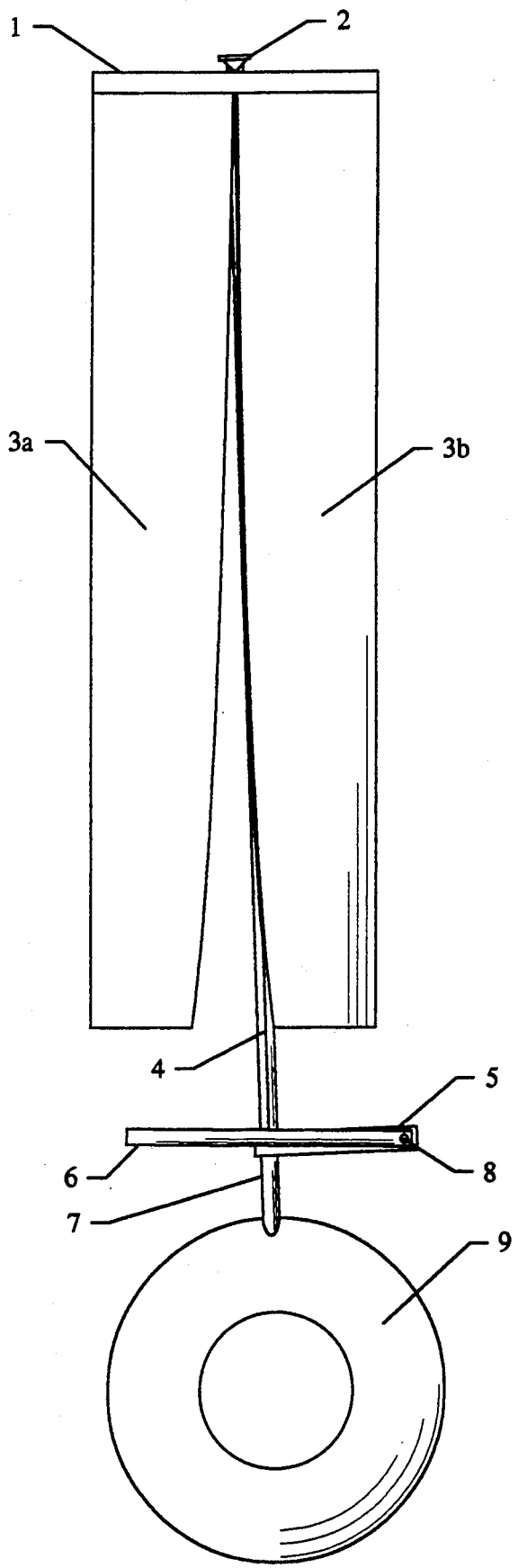
FIG. 3 is a front view of this invention with the pendulum at maximum amplitude to the right.
Figure 4:
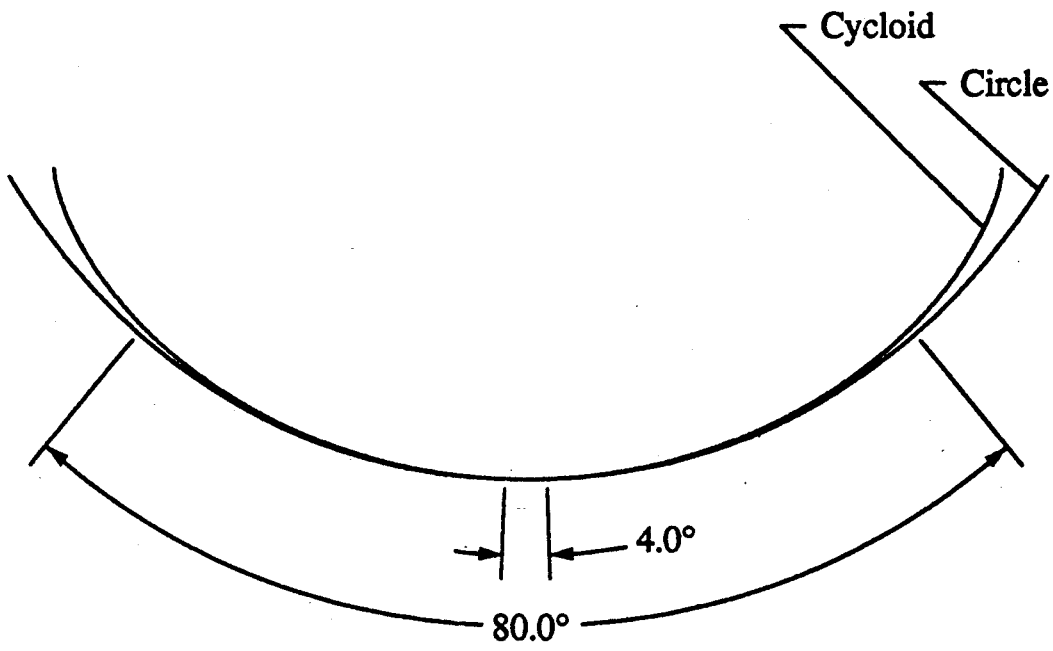
FIG. 4 is a comparison of a circle and a cycloid.

A typical embodiment of the pendulum of the present invention is illustrated in FIG. 1, FIG. 2, and FIG. 3. The pendulum includes a foundation (1) from which the remainder of the pendulum is suspended. A pendulum weight (9) is suspended via a pendulum rod (7) and a knife-edge pivot (2) from foundation (1). A left cheek (3*a*) and a right cheek (3*b*) are both solidly suspended from foundation (1). Left cheek (3*a*) and right cheek (3*b*) are separated by just enough distance to allow a suspension line (4) to pass between them to attach to foundation (1). A compensating mass (6) is attached to suspension line (4). Compensating mass (6) is also attached to pendulum rod (7) via a pivot mount (5) and a compensating mass pivot (8) in such a manner that it is free to rotate in the vertical plane. Suspension line (4) and compensating mass (6) are in the same plane and positioned so that suspension line (4) is between left cheek (3*a*) and right cheek (3*b*).

OPERATION OF THE INVENTION

The operation of this pendulum is based on the fact that its center of mass moves relative to pendulum weight (9). Moving the center of mass of the pendulum is accomplished by moving compensating mass (6) up and down as a function of the pendulum's angular position. If compensating mass (6) is moved so that the center of mass of the pendulum follows the path of a cycloid, the pendulum's vibrations will be isochronous for different amplitudes. The actual determination of the path of the suspension point of compensation mass (6) necessary to make the center of mass of the pendulum follow the path of a cycloid is dependent upon the relative masses of pendulum weight (9), pendulum rod (7), pivot mount (5), compensating mass (6), and their geometry. The calculation of the path is straightforward for one schooled in the art. The curve of left cheek (3*a*) is the locus of the centers of curvature of the path of the suspension point of compensation mass (6) to the left of center, and the curve of right cheek (3*b*) is the locus of the centers of curvature of the path of the suspension point of compensation mass (6) to the right of center.

Pulling suspension line (4) against left cheek (3*a*) or right cheek (3*b*) is done by compensating mass (6). As shown in FIG. 3, if the pendulum is to the right of center, suspension line (4) is pulled against right cheek (3*b*). since suspension line (4) has to follow the curve of right cheek (3*b*) instead of the shorter distance of a straight line, compensating mass (6) will be pulled up.

SUMMARY, RAMIFICATIONS, AND SCOPE

Accordingly, the reader will see that this invention provides for an isochronous pendulum that does not require springs, even when pendulum amplitudes are small. The reason this invention works for small amplitudes is that a relatively small mass is moved a relatively long distance. For example, if compensating mass (6) is 1/1,000 of the mass of pendulum weight (9), then the center of mass of compensating mass (6) must be moved up approximately 1,000 times the distance between the circle and the cycloid for any angular position of the pendulum. In contrast, Huyghens was moving the whole mass of the pendulum a very short distance; for this example, 1/1,000 as far as the center of mass of compensating mass (6) is moved. In both cases the center of mass of the pendulum theoretically follows the path of a cycloid, but it can be done more accurately—and thus for smaller amplitudes—as this invention discloses.

Another fundamental difference between this invention and Huyghens' is the shape of cheeks (3*a*) and (3*b*). In Huyghens'invention, since the whole mass of the pendulum was being moved from a circular path to follow the path of a cycloid, the cheeks themselves also had to be in the shape of a cycloid. In this invention a small fraction of the total mass is being moved. This dictates that the shape of cheeks (3*a*) and (3*b*) cannot be in the shape of a cycloid. As stated above, the actual shape of cheeks (3*a*) and (3*b*) is dependent upon the relative masses of pendulum weight (9), pendulum rod (7), pivot mount (5), compensating mass (6), and their geometry.

While my above description contains many specificities, these should not be construed as limitations on the scope of the invention, but rather as an exemplification of one preferred embodiment thereof. Many other variations are possible. For example, compensating mass (6) could be moved up and down by rolling on a cam. Two-or more-compensating masses instead of one could be used. The curves of left cheek (3*a*) and right cheek (3*b*) may deviate from the theoretical to compensate for real world problems such as friction, inertia, and escapement errors. Knife-edge pivot (2) could be replaced by a suspension spring. Pendulum weight (9) and pendulum rod (7) could be combined or considered as one primary mass of arbitrary shape. Temperature compensation methods could be applied to the pendulum. Also, this invention is not limited to clocks but may have application in other devices such as pendulum gravity meters. Accordingly, the scope of this invention should be determined not by the embodiment illustrated but by the appended claims and their legal equivalents.

Having described my invention, what I claim as new and desire to secure by Letters Patent is:

1. A cycloidal pendulum comprising:
   (a) a foundation,
   (b) a primary mass,
   (c) a pivot means to pivotally support said primary mass by said foundation,
   (d) a compensating mass smaller than said primary mass moveably attached to said primary mass,
   (e) a compensating means that causes the oscillations of the pendulum to move said compensating mass in such a manner that the center of mass of the pendulum moves substantially along the path of a cycloid.

2. The cycloidal pendulum of claim 1 wherein said primary mass comprises:
   (a) a pendulum rod,
   (b) a pendulum weight.

3. The cycloidal pendulum of claim 1 wherein said pivot means comprises a knife-edge pivot.

4. The cycloidal pendulum of claim 1 wherein said pivot means comprises a suspension spring.

5. The cycloidal pendulum of claim 1 wherein said compensating mass comprises a wire-shaped mass with one end rotatablely attached to said primary mass in such a manner that said wire-shaped mass is free to rotate in a vertical plane.

6. The cycloidal pendulum of claim 1 wherein said compensating means comprises:
   (a) a suspension line secured to said foundation and said compensating mass in such a manner so that when the pendulum is at zero degrees amplitude said suspension line hands vertically,
   (b) a left cheek and a right cheek each secured to said foundation in such a manner so that when the pendulum oscillates, said suspension line moves alternately against said left cheek and said right cheek,
   said left cheek and said right cheek are curved in such a manner so that when said suspension line is moved against said left cheek or said right cheek, said compensation mass is moved in such a manner that the center of mass of the pendulum moves substantially along the path of a cycloid.

* * * * *